US007372243B2

(12) United States Patent
Kimura

(10) Patent No.: US 7,372,243 B2
(45) Date of Patent: May 13, 2008

(54) REFERENCE VOLTAGE CIRCUIT DRIVEN BY NON-LINEAR CURRENT MIRROR CIRCUIT

(75) Inventor: Katsuji Kimura, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 0 days.

(21) Appl. No.: 11/657,021

(22) Filed: Jan. 24, 2007

(65) Prior Publication Data

US 2007/0176590 A1 Aug. 2, 2007

(30) Foreign Application Priority Data

Jan. 30, 2006 (JP) ..... 2006-020995

(51) Int. Cl.
*G05F 3/16* (2006.01)

(52) U.S. Cl. ..... 323/313; 323/315

(58) Field of Classification Search ..... 323/312, 323/313, 314, 315, 316; 327/536, 541
See application file for complete search history.

(56) References Cited

U.S. PATENT DOCUMENTS 5,625,281 A * 4/1997 Lambert ..... 323/315
5,977,759 A * 11/1999 Sitch ..... 323/315
6,160,391 A 12/2000 Banba
6,407,619 B1 * 6/2002 Tanaka ..... 327/536
6,452,437 B1 * 9/2002 Takeuchi et al. ..... 327/513
6,903,601 B1 * 6/2005 Aude ..... 327/541

FOREIGN PATENT DOCUMENTS

JP 11-45125 2/1999

OTHER PUBLICATIONS

"Analog Circuit Design Techniques for Applying CMOS to Mobile Wireless Terminals" (1999, published by Torrikeppsu K.K.), pp. 139-149.

* cited by examiner

*Primary Examiner*—Adolf Berhane
(74) *Attorney, Agent, or Firm*—McGinn IP Law Group, PLLC

(57) ABSTRACT

Disclosed is a reference voltage circuit which includes control means for exercising control so as to equalize a divided voltage that is output from a first current-to-voltage converting circuit having a diode-connected MOS transistor and voltage-dividing resistors and a divided voltage that is output from a second current-to-voltage converting circuit having a diode-connected MOS transistor and voltage-dividing resistors; a first current mirror circuit having a non-linear input/output characteristic for supplying currents to the first and second current-to-voltage converting circuits, respectively; a second current mirror circuit having a linear input/output characteristic for outputting a current proportional to the value of the current supplied to the first current-to-voltage converting circuit; and a third current mirror circuit having a linear input/output characteristic for outputting a current proportional to the value of the current supplied to the second current-to-voltage converting circuit. A third current-to-voltage converting circuit converts a current, which is the result of adding the output currents of the second and third current mirror circuits, to a voltage to supply the so converted voltage as a reference voltage.

11 Claims, 7 Drawing Sheets

REFERENCE VOLTAGE CIRCUIT DRIVEN BY NON-LINEAR CURRENT MIRROR CIRCUIT

FIELD OF THE INVENTION

This invention relates to a CMOS reference voltage circuit and, more particularly, to a CMOS reference voltage circuit formed on a semiconductor integrated circuit, the CMOS reference voltage circuit having a small chip area, operating from low voltage and exhibiting a temperature characteristic that is small.

BACKGROUND OF THE INVENTION

A conventional CMOS reference voltage circuit is described in detail in the specification of Japanese Patent Kokai Publication No. JP-A-11-45125. In terms of obtaining a reference voltage by a current-to-voltage conversion, this reference voltage circuit naturally is the same as an earlier devised reference voltage circuit of this kind in which a temperature characteristic is cancelled out. However, in the earlier devised reference voltage circuit in which the temperature characteristic is cancelled out, a reference current having a positive temperature characteristic is converted to a voltage by a circuit comprising a resistor and a diode (or a diode-connected transistor), and the circuit obtains a voltage component in which the amount of voltage drop at the resistor has a positive temperature characteristic and a voltage component in which the forward voltage at the diode (or diode-connected transistor) has a negative temperature characteristic, and adds these temperature characteristics, thereby obtaining a reference voltage of about 1.2V in which the temperature characteristic has been cancelled out.

On the other hand, with the proposed reference voltage circuit described in the above-cited Japanese Patent Kokai Publication No. JP-A-11-45125, a reference current having almost no temperature characteristic is obtained, the current is converted to a voltage by an output circuit comprising only a resistor, and a reference voltage having any desired voltage value is obtained.

Accordingly, since 1.2V, from which the temperature characteristic has been cancelled out, stipulated as the output voltage of this conventional type of reference voltage circuit is obtained upon being converted to a current value within the circuit, the reference voltage circuit is outstanding in that in can be operated at a power-supply voltage of less than 1.2V.

In the textbook entitled "Analog Circuit Design Techniques for Applying CMOS to Mobile Wireless Terminals" (1999, published by Torikeppsu K.K.), the author of which is the present Inventor, a "Current-Mode-Type Reference Voltage Circuit" that was made public immediately within the same year is introduced and a detailed circuit analysis thereof is described.

In particular, in reference voltage circuits thus far, since use is made of a forward voltage of a diode (or diode-connected transistor) and this is a voltage component having a negative characteristic, a deviation from the temperature characteristic regarding the forward voltage of the diode (or diode-connected transistor) appears in the output voltage to a marked extent.

That is, although the forward voltage of the diode (or diode-connected transistor) possesses a negative temperature characteristic, the slope of the negative temperature characteristic becomes blunt as temperature falls.

On the other hand, a voltage having a positive characteristic is realized by obtaining a current, which flows into a resistor, owing to a difference voltage between forward voltages of two diodes (or diode-connected transistors) having different current densities, and converting this current to a voltage by the resistor.

In accordance with the content described in the patent document cited above, the operation thereof will be described. As shown in FIG. 7, a resistor R2 is divided into voltage-dividing resistors R2A and R2B and a divided voltage VB' is output, and a resistor R4 is divided into voltage-dividing resistors R4A and R4B and a divided voltage VA' is output. Furthermore, the common gate voltage of transistors P1 and P2 is controlled by an operational amplifier (an ordinary operational amplifier or a differential amplifying circuit) in such a manner that VA'=VB' will hold.

Accordingly, we have $$VA'=VB' \tag{1}$$

Further, currents I1, I2 that are output from p-channel MOS transistors P1, P2, respectively, are equal to each other.

$$I1=I2 \tag{2}$$

The current I1 is split into a current I1A that flows into a diode D1 and a current I1B that flows into a resistor R4 (=R4A+R4B). Similarly, the current I2 is split into a current I2A that flows into a serially connected resistor R1 and commonly into N-number of parallel-connected diodes D2, and a current I2B that flows into a resistor R2 (=R2A+R2B).

If we assume the following:

$$R2=R4 \tag{3}$$

then Equations (4) and (5) below will hold.

$$I1A=I2A \tag{4}$$

$$I1B=I2B \tag{5}$$

Accordingly, we have the following:

$$VA=VB \tag{6}$$

Further, if we assume that the forward voltages of diodes D1 and D2 are VF1 and VF2, respectively, then replacing, we have the following:.

$$VA=VF1 \tag{7}$$

$$VB=VF2+\Delta VF \tag{8}$$

From Equations (7) and (8), we have the following:

$$\Delta VF=VF1-VF2 \tag{9}$$

The voltage drop across the resistor R1 is ΔVF, and the currents I2A and I1B are represented by Equations (10), (11), respectively, below.

$$I2A=\Delta VF/R1 \tag{10}$$

$$I1B=I2B=VF1/R2 \tag{1}$$

Here the following holds:

$$\Delta VF=VT1n(N) \tag{12}$$

where VT represents thermal voltage and is expressed by $$VT=kT/q \tag{13}$$

where T represents absolute temperature [K], k the Boltzmann constant and q the unit electronic charge.

An output current 13 (=I2) of a p-channel MOS transistor P3 is converted to a voltage by a resistor R3, and an output voltage Vref is expressed by Equation (14) below.

$$Vref = R3 \times 13 \quad (14)$$
$$= R3\{VF1/R2 + [VT1n(N)]/R1\}$$
$$= (R3/R2)\{VF1 + (R2/R1)[VT1n(N)]\}$$

In Equation (14), {VF1+(R2/R1)[VT1n(N)]} is a voltage value of about 1.205V from which the temperature characteristic has been cancelled. More specifically, VF1 has a negative temperature characteristic (temperature coefficient) of about −1.9 mV/° C., and VT has a positive temperature characteristic (temperature coefficient) of 0.0853 mV/° C. Accordingly, the temperature characteristic of the output voltage Vref is cancelled out, and therefore the value of (R2/R1)1n(N) is 22.27.

Further, since VT is 26 mV at an ambient temperature, (R2/R1)[VT1n(N)] is approximately 579 mV at an ambient temperature. Accordingly, if we assume that VF1 is 626 mV at an ambient temperature, then {VF1+(R2/R1)[VT1n(N)]} will be approximately 1.205V.

The temperature characteristic will now be discussed in detail. A resistor R4 is connected in parallel with the diode D1. If the temperature is low, therefore, the value of the current I1B that flows into the resistor R4 (=R4A+R4B) tends to decrease owing to the non-linearity of the temperature characteristic possessed by the diode. On the other hand, a resistor R1 is connected in series with the diode D2. If the current I2A that flows into the diode D2 has a positive temperature characteristic, therefore, then the voltage VB across the diode D2 and resistor R1 will fall below the voltage VA (=VF1) at the diode D1.

Owing to control by the operational amplifier DA1, the two voltages (the voltage VA at diode D1 and the voltage VB across diode D2 and resistor R1) become equal. With an increase in current (the current I2A that flows into the diode D2) at a low temperature, therefore, the two voltages become equal. At a high temperature, on the other hand, the action is the reverse.

That is, in the circuit shown in FIG. 7, the currents I1A and I2A that flow into the diodes D1 and D2, respectively, are set to a temperature characteristic that is lower than the temperature characteristic decided by [VT1n(N)]/R1, and the currents (VF1/R2, VF1/R4) that flow into the resistors R2 and R4, respectively, increase slightly at a low temperature.

Thus, since the drive currents I1, I2 and I3 that are supplied from the p-channel MOS transistors P1, P2 and P3 act in a direction that cancels out the non-linearity of the temperature characteristic exhibited by the forward voltage of the diodes, the temperature characteristic of the reference voltage obtained can also be set to a characteristic that is very near a straight line having little fluctuation with respect to temperature.

Further, since the ratio of the resistors (R3/R2) does not possess a temperature characteristic, the reference voltage Vref that is output also is a voltage from which the temperature characteristic has been cancelled out. Here the resistor ratio (R3/R2) can be set at will.

If I<(R3/R2) is set, the output voltage Vref becomes a voltage higher than 1.205 V, and if I>(R3/R2) is set, the output voltage Vref becomes a voltage lower than 1.205 V In the above-cited patent document, N=10 is described as the specific value of N. When the circuit is actually implemented [IEEE Symposium on VLSI Circuits (May)], however, N=100 holds.

In the CMOS process, the progress of finer patterning has resulted in MOS transistors of very small size. By contrast, the size of diodes that employ parasitic bipolar elements is greater than that of MOS transistors by an order of magnitude.

Further, since the ratio N between the diodes D1 and D2 in FIG. 7 is enlarged from one to two digits, the area on the chip is enlarged. [Patent Document 1]

Japanese Patent Kokai Publication No. JP-A-11-45125

SUMMARY OF THE DISCLOSURE

The circuit described in the above-cited patent document has the problems set forth below.

The first problem is an increase in a chip area. The reason is that the diode constituted by a parasitic transistor has a large area.

The second problem is a large variation. The reason is that although temperature dependence is decided predominantly by a p-channel MOS transistor that constitute a current mirror circuit and a diode, the p-channel MOS transistor and diode each vary individually.

In view of the problems set forth above, the present invention seeks to implement a reference voltage circuit that can use a p-channel MOS transistor for a diode, thereby realizing a reference voltage circuit of small chip area that operates from a low voltage and outputs any desired reference voltage exhibiting only a small temperature characteristic. Further, by adopting the same circuit topology for two current-to-voltage converting circuits for being compared and an output current-to-voltage converting circuit, a reference voltage circuit that is little affected by element variations is achieved.

The present invention provides a reference voltage circuit comprising: first and second current-to-voltage converting circuits; control means for exercising control in such a manner that a prescribed output voltage of the first current-to-voltage converting circuit and a prescribed output voltage of the second current-to-voltage converting circuit will become equal; a first current mirror circuit, which has a non-linear input/output characteristic, for supplying current to each of the first and second current-to-voltage converting circuits; a second current mirror circuit, which has a linear input/output characteristic, for outputting a current that is proportional to the value of the current supplied to the first current-to-voltage converting circuit; and a third current mirror circuit, which has a linear input/output characteristic, for outputting a current that is proportional to the value of the current supplied to the second current-to-voltage converting circuit; wherein output current from the second current mirror circuit and output current from the third current mirror circuit are added and the resultant current is converted to voltage via a third current-to-voltage converting circuit and the voltage is supplied.

In the present invention, it is preferred that the third current-to-voltage converting circuit comprise a resistor.

In the present invention, it is preferred that the first and second current-to-voltage converting circuits each include a diode-connected MOS transistor and a voltage-dividing resistor connected in parallel with the MOS transistor; wherein divided voltages from the voltage-dividing resistors of respective ones of the first and second current-to-voltage converting circuits are output as the prescribed output voltages of respective ones of the first and second current-to-voltage converting circuits.

In the present invention, the first current-to-voltage converting circuit has a diode and a voltage-dividing resistor connected in parallel with the diode, and the second current-to-voltage converting circuit has a series circuit, which comprises one diode or a plurality of parallel-connected diodes and a resistor, and a voltage-dividing resistor connected in parallel with the series circuit; wherein divided voltages from the voltage-dividing resistors of respective ones of the first and second current-to-voltage converting circuits are output as the prescribed output voltages of respective ones of the first and second current-to-voltage converting circuits. In the present invention, the diode may be a diode-connected bipolar junction transistor (BJT).

In the present invention, the control means includes a differential amplifying circuit having differential input terminals for receiving respective ones of the prescribed output voltage of the first current-to-voltage converting circuit and the prescribed output voltage of the second current-to-voltage converting circuit, and an output terminal for delivering a voltage that controls a common node of the first to third current mirror circuits.

In the present invention, a diode-connected MOS transistor and a resistor are connected in parallel and a divided voltage is adopted as a voltage to be controlled, thereby lowering the input voltage of a differential amplifying circuit (operational amplifier) and facilitating the implementation of low-voltage operation. Furthermore, in an embodiment of the present invention, there is obtained a reference voltage circuit in which a temperature characteristic is cancelled and which operates from low voltages by setting the output reference voltage set to a low, constant voltage of not more than 1.0V. By constituting the circuit using two diode-connected MOS transistors, the circuit can be implemented with a small chip area.

The meritorious effects of the present invention are summarized as follows.

In accordance with the present invention, it is possible to reduce chip area. The reason for this is that in the present invention, a reference voltage circuit in which the temperature characteristic has been cancelled out can be implemented by MOS transistors without relying upon diodes. In particular, a reference voltage circuit in which the temperature characteristic has been cancelled can be implemented without using parasitic bipolar junction transistors. This contributes to a decrease in chip area.

In accordance with the present invention, the circuit can be operated at low voltages. The reason for this is that in the present invention, the output voltage (reference voltage) can be made any voltage value of 1.0V or less.

In accordance with the present invention, the effects of variation can be reduced. The reason for this is that in the present invention, the circuit is implemented using only MOS transistors and resistors, which are circuit elements, other than those of the differential amplifying circuit (differential amplifier), that predominantly decide the temperature characteristic.

Still other features and advantages of the present invention will become readily apparent to those skilled in this art from the following detailed description in conjunction with the accompanying drawings wherein embodiments of the invention are shown and described, simply by way of illustration of the mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

DESCRIPTION OF THE INVENTION

Figure 1:
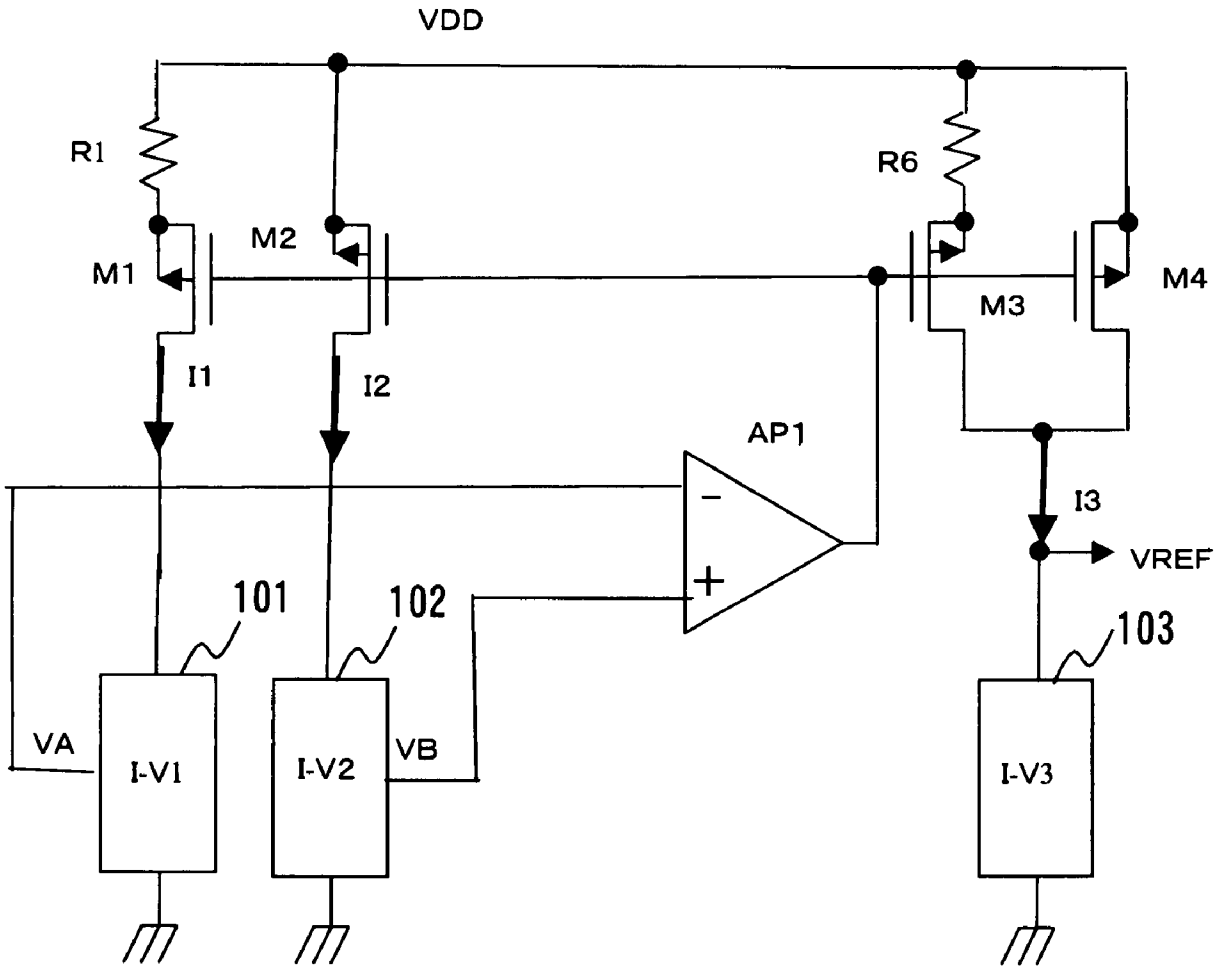
FIG. 1 is a diagram illustrating a circuit configuration embodying the present invention.

The present invention will now be described in detail with reference to the drawings. The present invention includes first to third current-to-voltage converting circuits (101, 102 and 103), first to fourth MOS transistors (M1, M2, M3 and M4) having their gates coupled together, and a differential amplifying circuit (or operational amplifier) (AP1). The first current-to-voltage converting circuit (101) preferably includes a diode-connected fifth MOS transistor (namely a MOS transistor having a coupled drain and gate) (M5) and first voltage-dividing resistors (R2 and R3) connected in parallel with the fifth MOS transistor (M5). The second current-to-voltage converting circuit (102) preferably includes a diode-connected sixth MOS transistor (M6) and second voltage-dividing resistors (R4 and R5) connected in parallel with the second MOS transistor (M6). The third current-to-voltage converting circuit (103) comprises a resistor (R7). The sources of the first and third MOS transistors (M1 and M3) are connected to a power supply (VDD) via resistors (R1 and R6), respectively. The sources of the second and fourth MOS transistors (M2 and M4) are connected to the power supply (VDD), directly. The drains of the first and second MOS transistors (M1 and M2) are connected to the sources of the fifth and sixth MOS transistors (M5 and M6), respectively, of the first and second current-to-voltage converting circuits (101 and 102), respectively. First and second divided voltages (VA and VB) obtained by the first and second voltage-dividing resistors of the first and second current-to-voltage converting circuits (101 and 102), respectively, are applied to an inverting input terminal (−) and non-inverting input terminal (+) of the differential amplifying circuit (AP1). The output terminal of the differential amplifying circuit (AP1) is connected to the coupled gates of the first to fourth MOS transistors (M1, M2, M3 and M4). The first and second MOS transistors (M1 and M2) constitute a current mirror having a non-linear input/output characteristic, and first and third MOS transistors (M1 and M3) constitute a current mirror having a linear input/output characteristic, and the second and fourth MOS transistors (M2 and M4) constitute a current mirror having a linear input/output characteristic. The drains of the third and fourth MOS transistors (M3 and M4) are coupled together and connected to the resistor (R7) of the third current-to-voltage converting circuit (103). An output voltage (VREF) is delivered from the node at which the resistor (R7) of the third current-to-voltage converting circuit (103) is connected to the coupled drains of the third and fourth MOS transistor (M3 and M4).

Alternatively, according to the present invention, the first current-to-voltage converting circuit (101) includes a first diode (D1) having its cathode connected to ground, and first voltage-dividing resistors (R2 and R3) connected in parallel with the diode (D1). The second current-to-voltage converting circuit (102) includes a series circuit comprising a plurality of diodes (D2) having their cathodes connected to ground and their anodes coupled together and a resistor (R0) having a first end connected to the common node of the plurality of diodes (D2), and second voltage-dividing resistors (R4 and R5) connected in parallel with the series circuit. The third current-to-voltage converting circuit (103) comprises the resistor (R7) having a first end connected to ground. The drain of the first MOS transistor (M1) is connected to the anode of the diode (D1) of the first current-to-voltage converting circuit (101). The drain of the second MOS transistor (M2) is connected to the second end of resistor (R0) of the second current-to-voltage converting circuit (102).

In accordance with this embodiment, characteristics and performance can be improved. For example, any output voltage equal to or greater than 1V or less than 1V is obtained. Further, a high precision is obtained. That is, the effects of element variation are alleviated and so are the effects of non-linear temperature characteristics of diodes. Furthermore, it is possible to achieve lower voltage. That is, by making output voltage lower than 1V, operation is possible from about 1.2V. The details of circuitry and operation of the present invention will now be described in detail.

FIG. 1 is a diagram illustrating the circuit configuration of a reference voltage circuit according to the present invention. If the first current-to-voltage converting circuit 101 and second current-to-voltage converting circuit 102 were constructed to be exactly identical, the operating points would be infinite in number indeterminate. In this embodiment, however, as illustrated in FIG. 1, the first current-to-voltage converting circuit 101 and second current-to-voltage converting circuit 102 are so arranged that the operating points will not be three or more. The operating point of the circuitry should be a single operating point. If there are two operating points, then it is necessary to add on a circuit so as to arrive at the desired operating point.

For example, in a self-bias circuit often seen in reference voltage circuits of this kind, there are two operating points. It is well known in the art that it is necessary to add on a so-called start-up circuit in such a manner that the operating point of the circuit will not migrate to an operating point that prevails in a case where there is no flow of current in the circuit.

In FIG. 1, a p-channel MOS transistor M1 in which a source resistor has been inserted and a p-channel MOS transistor M2 having no source resistor form a non-linear current mirror circuit constituting a first current mirror circuit. The voltage at the coupled gates of the transistors M1 and M2 is controlled by the operational amplifier AP1 so as to equalize the voltage at the inverting input terminal (−) and the voltage at the non-inverting input terminal (+) of the amplifier. As a result, the currents that flow into the MOS transistors M1 and M2 constituting the first current mirror circuit are decided.

The p-channel MOS transistor M1 and a p-channel MOS transistor M3 form a linear current mirror circuit constituting a second current mirror circuit. The voltage at the coupled gates of these transistors is similarly controlled by the operational amplifier AP1.

Similarly, the p-channel MOS transistor M2 and a p-channel MOS transistor M4 form a linear current mirror circuit constituting a third current mirror circuit, and the voltage at the coupled gates of these transistors is controlled by the operational amplifier AP1.

The output currents from the second and third current mirror circuits (the drain currents of the MOS transistors M3 and M4) are each weighted, and currents flow into the third current-to-voltage converting circuit 103 via the MOS transistors M1 and M2 and are converted to a desired reference voltage VREF.

What is noteworthy here is the temperature characteristic of the non-linear current mirror circuit constituting the first current mirror circuit. In such a non-linear current mirror circuit referred to as a Widlar current mirror circuit, the output current (drain current I1 of the MOS transistor M1) has a positive temperature characteristic with respect to the input reference current (drain current I2 of the MOS transistor M2).

That is, the currents I1 and I2 that flow respectively into the MOS transistors M1 and M2 constituting the first current mirror circuit have temperature characteristics that are different each other. The circuit has a temperature characteristic. Accordingly, the circuit may be considered to have a positive or negative temperature characteristic regardless of whether the temperature characteristic is large or small.

Accordingly, in a case where the prescribed output voltages of the first and second current-to-voltage converting circuits 101 and 102 become equal, there is a possibility that if the current that flows into the second current-to-voltage converting circuit 102 can be set to have a somewhat negative temperature characteristic, then the current that flows into the first current-to-voltage converting circuit 101 can be set to cancel out this negative temperature characteristic and have a somewhat positive temperature characteristic. In this case, it is possible for a reference voltage, which is obtained upon canceling out temperature characteristics by weighting and adding the current having the negative temperature characteristic that flows into the second current-to-voltage converting circuit 102 and the current having the positive temperature characteristic that flows into the first current-to-voltage converting circuit 101, to be set in such a manner that it will have almost no temperature characteristic. This will be described with respect to specific examples.

Figure 2:
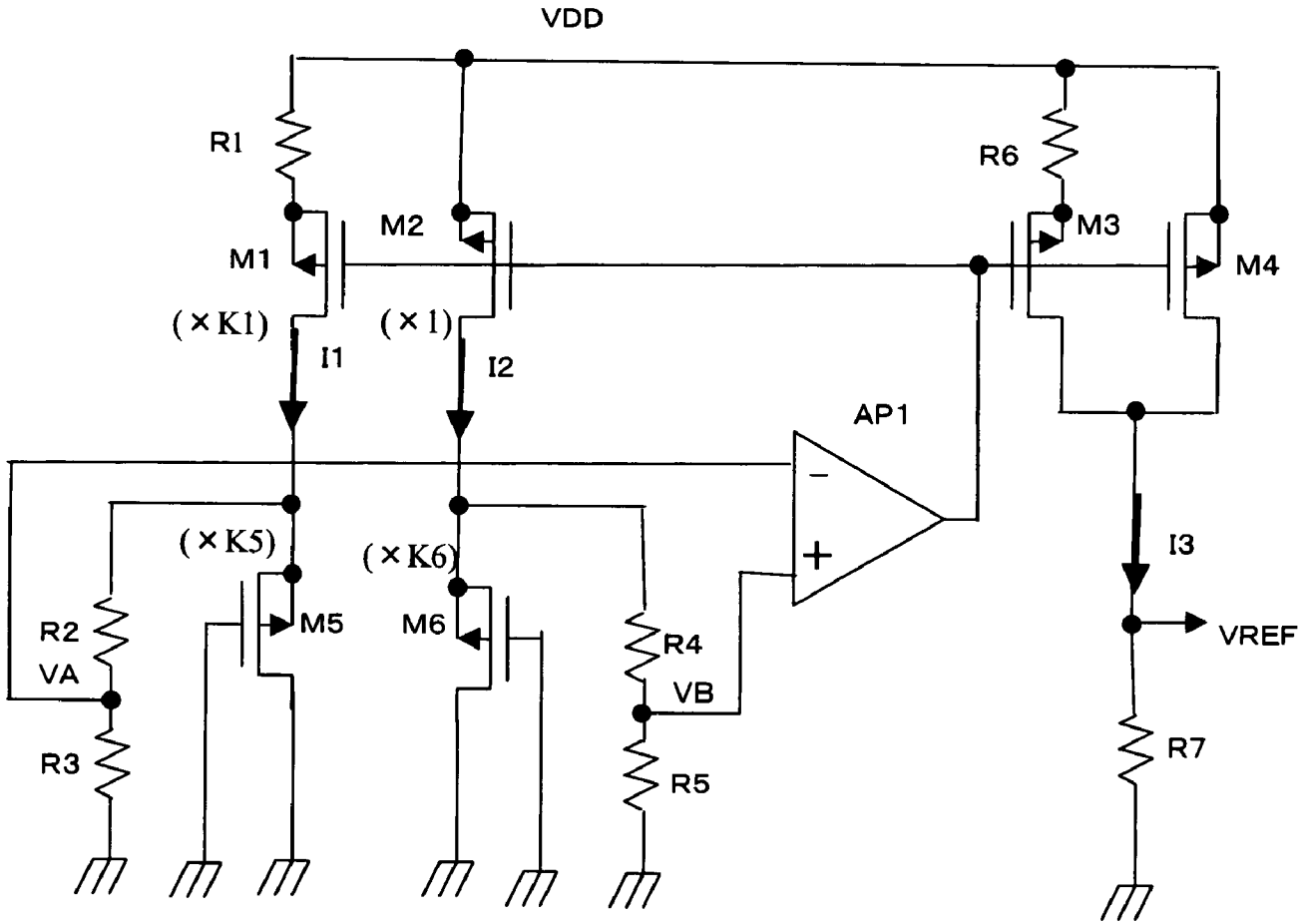
FIG. 2 is a diagram illustrating a circuit configuration according to an embodiment of the present invention.

FIG. 2 is a diagram illustrating a circuit configuration that is an example of a reference voltage circuit according to the present invention. The reference voltage circuit shown in FIG. 1 illustrates how the first and second current-to-voltage converting circuits should be configured so that the reference voltage obtained will have almost no temperature characteristic.

As shown in FIG. 2, a p-channel MOS transistor M1 in which a source resistor R1 has been inserted and a p-channel MOS transistor M2 having no source resistor (the source is connected directly to the power supply VDD) form a non-linear current mirror circuit constituting a first current mirror circuit. The voltage at the coupled gates of these transistors is controlled by the output of the operational amplifier AP1 so as to equalize the voltage at the inverting input terminal (−) and the voltage at the non-inverting input terminal (+) of the amplifier. As a result, currents I1 and I2 that flow respectively into the MOS transistors M1 and M2 constituting the first current mirror circuit are decided.

P-channel MOS transistors M1 and M3 form a linear current mirror circuit constituting a second current mirror circuit. The voltage at the coupled gates of these transistors M1 and M3 is similarly controlled by the output of the operational amplifier AP1.

Similarly, p-channel MOS transistors M2 and M4 form a linear current mirror circuit constituting a third current mirror circuit, and the voltage at the coupled gates of these transistors M2 and M4 is controlled by the output of the operational amplifier AP1.

In the implementation shown in FIG. 2, each of the first and second current-to-voltage converting circuits comprises a diode-connected p-channel MOS transistor and voltage-dividing resistors connected in parallel with the transistor. More specifically, as illustrated in FIG. 2, the first current-to-voltage converting circuit 101 (see FIG. 1) includes diode-connected p-channel MOS transistor M5 (the drain and gate whereof connected to ground) having its source connected to the drain of the first p-MOS transistor M1, and voltage-dividing resistors R2 and R3 connected between the source of p-channel MOS transistor M5 and ground. The second current-to-voltage converting circuit 102 (see FIG. 1) includes diode-connected p-channel MOS transistor M6 (the drain and gate whereof connected to ground) having its source connected to the drain of the second p-MOS transistor M2, and voltage-dividing resistors R4, R5 connected between the source of p-channel MOS transistor M6 and ground. A connection node (VA) of the resistors R2 and R3 and a connection node (VB) of the resistors R4 and R5 are connected respectively to the inverting input terminal (−) and non-inverting input terminal (+) of the operational amplifier AP1. The diode-connected p-channel MOS transistor M5 and the diode-connected p-channel MOS transistor M6 are of different sizes. Further, the voltage-dividing resistors R2 and R3 have resistance values that differ from those of the voltage-dividing resistors R4 and R5, and the dividing ratio R3/(R2+R3) differs from the dividing ratio R5/(R4+R5).

The output currents from the second and third current mirror circuits (the drain currents of the MOS transistors M3 and M4) are each weighted, and currents flow into the third current-to-voltage converting circuit, which comprises resistor R7, via the MOS transistors M1 and M2 and are converted to the desired reference voltage VREF.

In FIG. 2, let VGS5 and VGS6 represent gate-to-source voltages of the diode-connected MOS transistors M5 and M6, respectively. The voltage-dividing resistors R2 and R3 are connected in parallel with the diode-connected MOS transistor M5, the voltage-dividing resistors R4 and R5 are connected in parallel with the diode-connected MOS transistor M6, and control is exercised by the operational amplifier AP1 in such a manner that the two divided voltages will become equal (i.e., in such a manner that VA=VB will hold).

In a circuit of this kind, describing operation by performing circuit analysis is difficult. The circuit conditions will be enumerated. Since VA=VB holds, Equation (15) below holds.

$$\frac{R_3}{R_2+R_3}V_{GS5}=\frac{R_5}{R_4+R_5}V_{GS6} \tag{15}$$

If we assume that the gate W/L's of the MOS transistors M5 and M6 are K5 and K6 times, respectively, that of a unit MOS transistor (transistor M2 in FIG. 2), then currents I1A and I2A that flow into the respective MOS transistors M5 and M6 will be as indicated by Equations (16) and (17) below.

$$K_5\beta(V_{GS5}-V_{TH})^2=I_{1A} \tag{16}$$

$$K_6\beta(V_{GS6}-V_{TH})^2=I_{2A} \tag{17}$$

With regard to currents I1 and I2 that are output from the non-linear current mirror circuit (M1 and M2), the current I1 is split into current I1B that flows into the voltage-dividing resistors R2 and R3 and current I1A that flows into the diode-connected MOS transistor M5, and the current I2 is split into current I2B that flows into the voltage-dividing resistors R4 and R5 and current I2A that flows into the diode-connected MOS transistor M6. Accordingly, the currents I1, I2 are represented by Equations (18) and (19) below.

$$I1=I1A+I1B \tag{18}$$

$$I2=I2A+I2B \tag{19}$$

Substituting Equations (16) and (17) and $I1B=V_{GS5}/(R2+R3)$, $I2B=V_{GS6}/(R4+R5)$, Equations (18) and (19) become Equations (20) and (21) below.

$$K_5\beta(V_{GS5}-V_{TH})^2+\frac{V_{GS5}}{R_2+R_3}=I_1 \tag{20}$$

$$K_6\beta(V_{GS6}-V_{TH})^2+\frac{V_{GS6}}{R_4+R_5}=I_2 \tag{21}$$

Solving Equations (20) and (21), Equations (22) and (23) below hold.

$$V_{GS5}=V_{TH}-\frac{1}{2K_5\beta(R_2+R_3)}+\sqrt{\left\{V_{TH}-\frac{1}{2K_5\beta(R_2+R_3)}\right\}^2-V_{TH}^2+\frac{I_1}{K_5^2\beta^2}} \tag{22}$$

$$V_{GS6}=V_{TH}-\frac{1}{2K_6\beta(R_4+R_5)}+\sqrt{\left\{V_{TH}-\frac{1}{2K_6\beta(R_4+R_5)}\right\}^2-V_{TH}^2+\frac{I_2}{K_6^2\beta^2}}$$

Substituting Equations (22) and (23) into Equation (15), we have Equation (24) below.

$$\frac{R_3}{R_2+R_3}\left[V_{TH}-\frac{1}{2K_5\beta(R_2+R_3)}+\sqrt{\left\{V_{TH}-\frac{1}{2K_5\beta(R_2+R_3)}\right\}^2-V_{TH}^2+\frac{I_1}{K_5^2\beta^2}}\right]=\frac{R_5}{R_4+R_5}\left[V_{TH}-\frac{1}{2K_6\beta(R_4+R_5)}+\sqrt{\left\{V_{TH}-\frac{1}{2K_6\beta(R_4+R_5)}\right\}^2-V_{TH}^2+\frac{I_2}{K_6^2\beta^2}}\right] \tag{24}$$

Here it will suffice if currents I1 and I2 and parameters β, R2, R3, R4, R5, $V_{TH}$, K5 and K6 for which Equation (24) holds exists.

Figure 3:
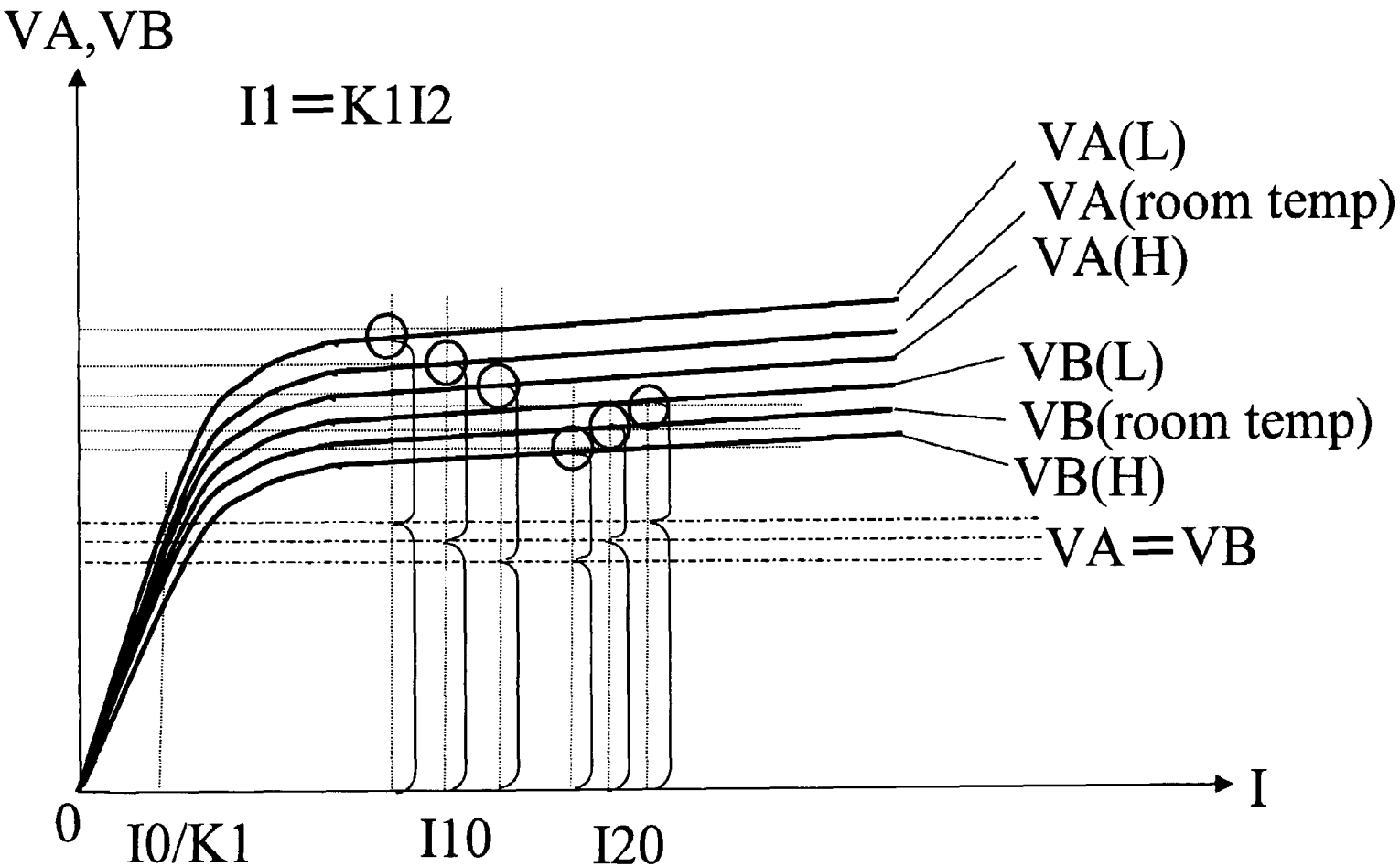
FIG. 3 is a first diagram useful in describing the operation of the circuit shown in FIG. 2.

In particular, the threshold voltage $V_{TH}$ has a negative temperature characteristic, and the transconductance parameter β is a parameter that is proportional to a mobility μ and has a negative temperature characteristic. If this is illustrated in concrete form, the result is as shown in FIG. 3, which is a diagram illustrating the operation of the first and second current-to-voltage converting circuits of FIG. 2. The horizontal axis in FIG. 3 is a plot of current, and the vertical axis is a plot of voltage VA (the divided voltage of resistors R2 and R3) and VB (the divided voltage of resistors R4 and R5). Characteristics for room-temperature VA (room temp) and VB (room temp), low-temperature VA (L) and VB (L), and high-temperature VA (H) and VB (H) are illustrated. Here VA=VB corresponds to an operating point at which VA=VB holds at room temperature, low temperature and high temperature.

Further, since the MOS transistor M1 in which the source resistor R1 has been inserted and the MOS transistor M2 having no source resistor form a non-linear current mirror circuit, specifically a Widlar current mirror circuit, the currents I1 and I2 that flow into the MOS transistors M1 and M2, respectively, are represented by Equations (25) and (26) below, in which MOS transistor M2 serves as a unit MOS transistor.

$$K_1\beta(V_{GS1}-V_{TH})^2=I_1 \tag{25}$$

$$\beta(V_{GS2}-V_{TH})^2=I_2 \tag{26}$$

Further, since the gates of the MOS transistor M1 and MOS transistor M2 are coupled together, the sum of the gate-to-source voltage VGS1 of MOS transistor M1 and terminal voltage R1I1 of resistor R1 becomes the gate-to-source voltage VGS2 of the MOS transistor M2 and satisfies Equation (27) below.

$$V_{GS2}=V_{GS1}+R_1I_1 \tag{27}$$

Substituting Equation (27) into Equations (25) and (26) and solving, we have the following:

$$I_2=\beta I_1\left(R_1\sqrt{I_1}+\frac{1}{\sqrt{K_1\beta}}\right)^2 \tag{28}$$

Figure 4:
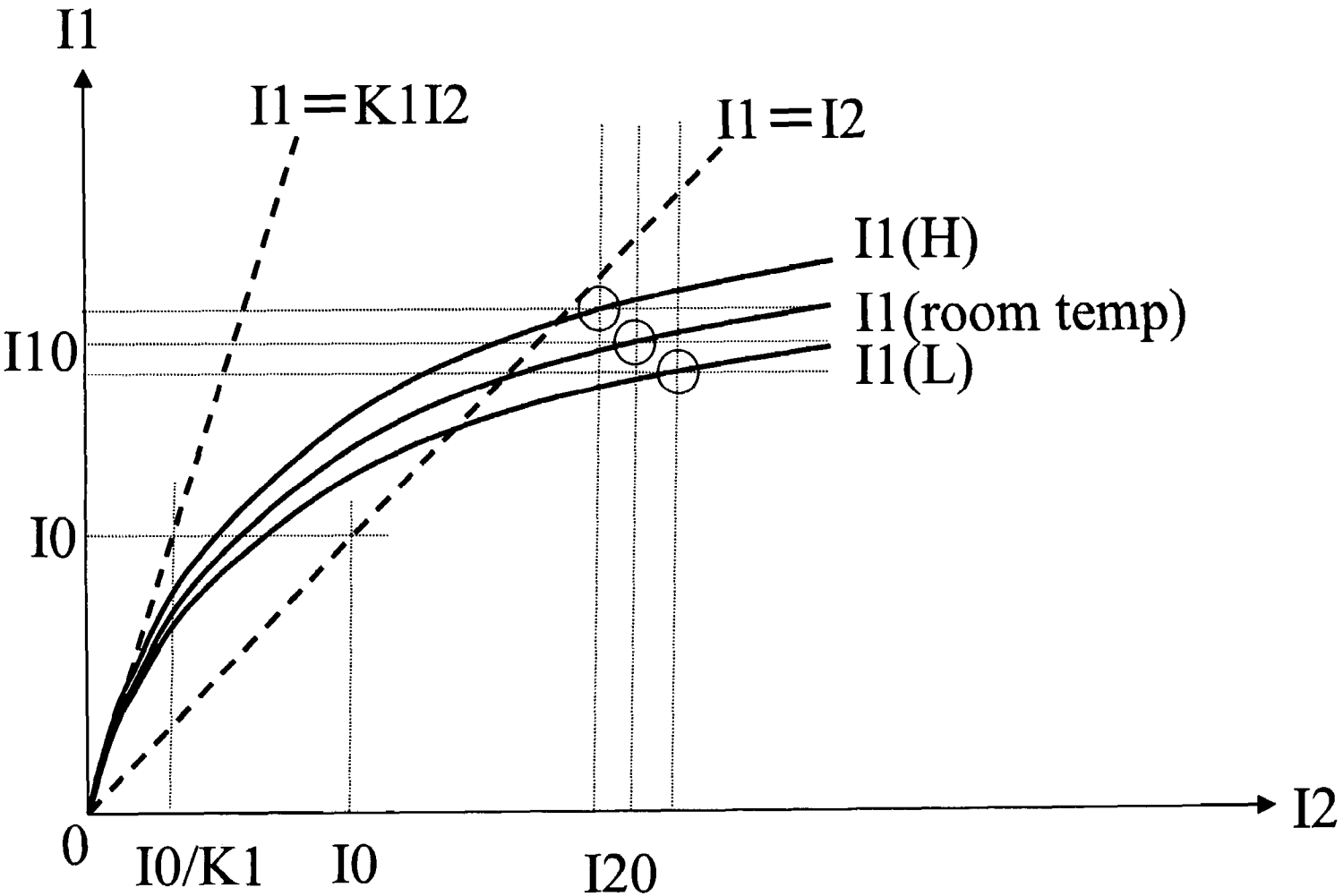
FIG. 4 is a second diagram useful in describing the operation of the circuit shown in FIG. 2.

Equation (28) illustrates the input/output characteristic of the well-known Widlar current mirror circuit. It should be noted that this equation is not indicated by a function of type I1=f(I2) but by the inverse function, namely I2=f(I1). If illustrated, the result is as shown in FIG. 4. With regard to I1, I2 of Equation (28), the horizontal axis in FIG. 4 is a plot of I2 and the vertical axis is a plot of I1 in regard to room-temperature I1 (room temp), low-temperature I1 (L) and high-temperature I1 (H). It should be noted that the circle marks in FIG. 4 represent operating points at room temperature (I2, I1)=(I20, I10), low temperature and high temperature.

Thus, it will be understood that if the temperature characteristics become the opposite of each other, such as the temperature characteristic of current I1 being positive and the temperature characteristic of current I2 being negative, then the divided output voltage VA of the first current-to-voltage converting circuit and the divided output voltage VB of the second current-to-voltage converting circuit in FIG. 2 will agree and the operating point of the circuit will be decided.

What is noteworthy here is that the voltage-dividing resistor ratios R3(R2+R3) and R5/(R4+R5) in Equation (15) are constant values that do not possess a temperature characteristic.

By contrast, even if the temperature characteristics of the resistors is neglected, the gate-to-source voltages VGS5 and VGS6 of the p-channel MOS transistors M5 and M6 are governed by temperature characteristics possessed by the parameters β and VTH.

Accordingly, in a self-biased linear current mirror circuit, even if the first current-to-voltage converting circuit 101 and second current-to-voltage converting circuit 102 are driven by mutually proportional currents whose temperature characteristics are equal so that the divided output voltage VA of the first current-to-voltage converting circuit 101 and the divided output voltage VB of the second current-to-voltage converting circuit 102 are made to agree, naturally the temperature characteristics of the two drive currents will agree and will be positive temperature characteristics. However, if drive is performed by a non-linear current mirror circuit, as in the present invention, it will be unnecessary for the two currents to be proportional. The operating point is therefore decided with a degree of freedom and a difference will occur also in the temperature characteristics between the driving currents.

A Widlar current mirror circuit, which is a non-linear current mirror circuit, has a positive temperature characteristic inherently. It is also possible, therefore, to set the temperature characteristic of one current to negative and set the temperature characteristic of the other current to positive.

Example of Result of Simulation

Figure 5:
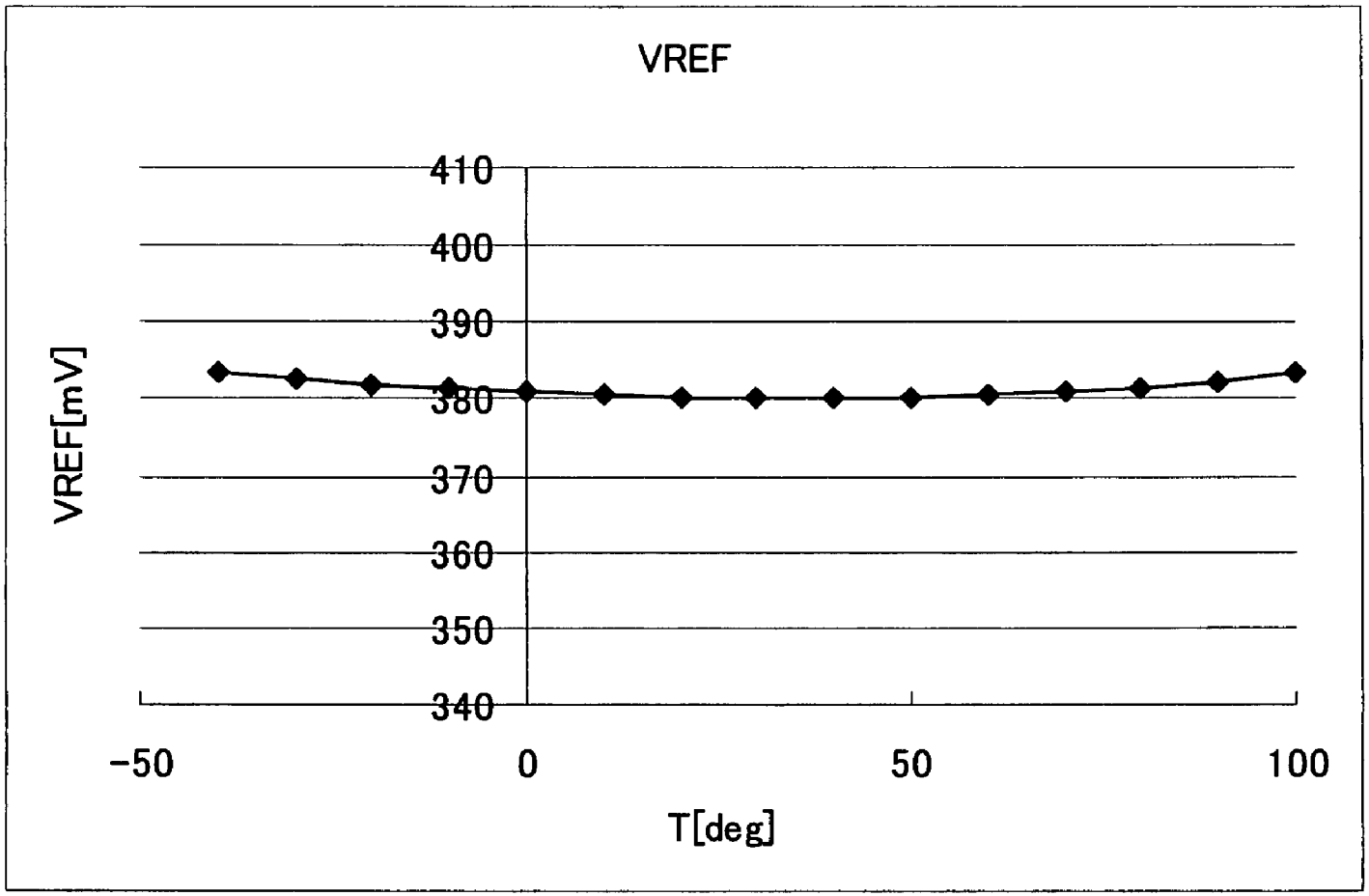
FIG. 5 is a characteristic diagram that simulates the circuit shown in FIG. 2.

FIG. 5 is a diagram illustrating the result of a SPICE simulation of the circuit shown in FIG. 2. Here the temperature characteristic of VREF is illustrated. When VDD=1.2V holds and the W/L of the unit transistor is assumed to be 54 μm/1.08 μm, assume that K1=2, K5=1, K6=1.5, R1=10 KΩ, R2=170 KΩ, R3=30 KΩ, R4=79 KΩ and R5=15 KΩ hold. On the side of the output circuit, assume that K3=1.85, K4=0.74, R6=4 kΩ hold. In this case, with R5=15 KΩ, the VREF obtained will be 383.55 mV at −40° C., 380.175 mV at 27° C. and 383.37 mV at 100° C., and the temperature characteristic is +0.145% at a change of 140° C. The minimum voltage is at ordinary temperatures and the voltage rises minutely at low and high temperatures. Hence the temperature characteristic obtained has a very slight bowl-shaped appearance.

Figure 6:
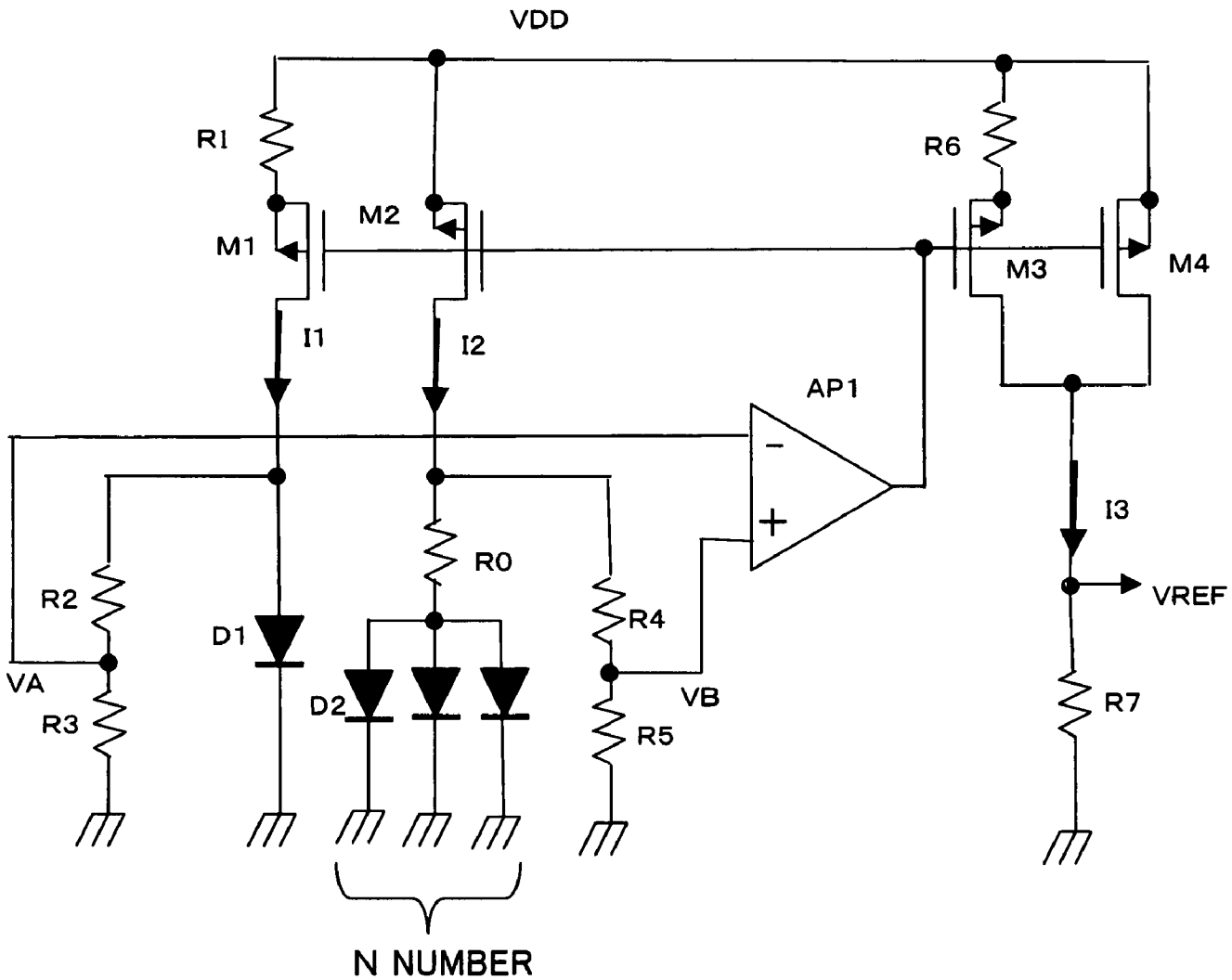
FIG. 6 is a diagram illustrating a circuit configuration according to an embodiment of the present invention.
Figure 7:
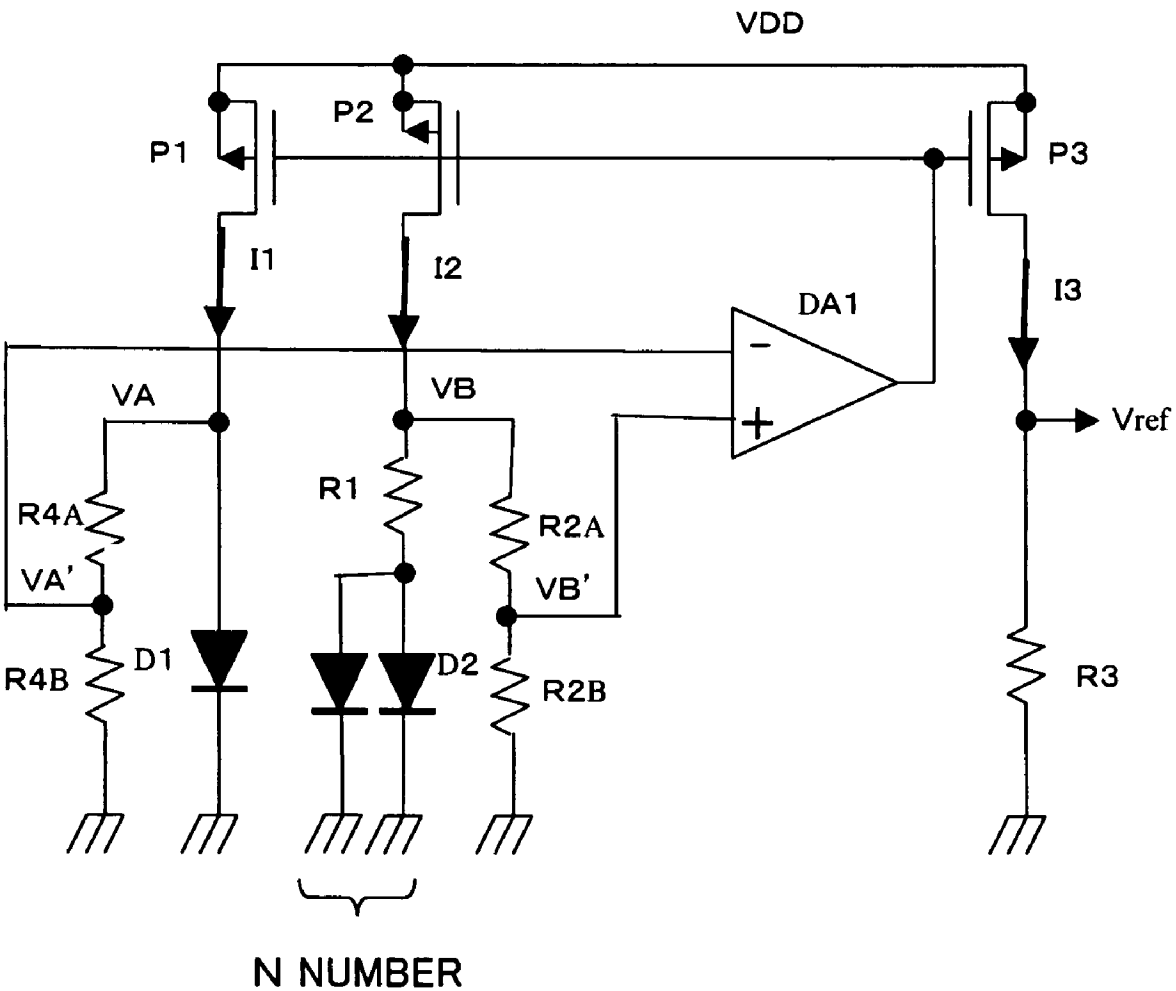
FIG. 7 CONVENTIONAL ART
FIG. 7 is a diagram illustrating a circuit configuration described in the specification of Japanese Patent Kokai Publication No. 11-45125.

It goes without saying that the diode-connected MOS transistors of the first and second current-to-voltage converting circuits can be changed to diode-connected bipolar transistors or diodes, as illustrated in FIG. 6.

In order that the operating point will be decided in the second current-to-voltage converting circuit, the number of diode-connected bipolar transistors or diodes is made N and a resistor R0 is added. In the implementation of FIG. 6, the first current-to-voltage converting circuit 101 of FIG. 1 includes diode D1 having its cathode connected to ground and its anode to the drain of the p-channel MOS transistor M1, and voltage-dividing resistors R2 and R3 connected between the anode of the diode D1 and ground. The second current-to-voltage converting circuit 102 of FIG. 1 includes three diodes D2 having their cathodes connected in common with ground, resistor R0 connected between the coupled anodes of the diodes D2 and the drain of MOS transistor M2, and voltage-dividing resistors R4 and R5 connected between ground and the node at which the resistor R0 and the drain of MOS transistor M2 are connected.

Various reference voltage circuits integrated on an LSI chip can be mentioned as an example of use of the present invention. In particular, recent advances in terms of the formation of ever finer patterns in IC processes have been accompanied by a reduction in the power-supply voltage supplied to LSI circuits and there is now need for stable reference voltage circuits that are free of temperature fluctuation and that operate at power-supply voltages of about 1V. The present invention satisfies this need.

As many apparently widely different embodiments of the present invention can be made without departing from the spirit and scope thereof, it is to be understood that the invention is not limited to the specific embodiments thereof except as defined in the appended claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A reference voltage circuit comprising:

first and second current-to-voltage converting circuits, each of which receives a current and converts the current to a voltage;

a control circuit that exercises control in such a manner that a prescribed output voltage of said first current-to-voltage converting circuit and a prescribed output voltage of said second current-to-voltage converting circuit will become equal;

a first current mirror circuit that has a non-linear input/output characteristics and supplies currents to respective ones of said first and second current-to-voltage converting circuits;

a second current mirror circuit that has a linear input/output characteristic, and outputs a current which is proportional to a value of the current supplied to said first current-to-voltage converting circuit;

a third current mirror circuit that has a linear input/output characteristic, and outputs a current which is proportional to the value of the current supplied to said second current-to-voltage converting circuit; and a third current-to-voltage converting circuit that receives a current which is the result of adding an output current from said second current mirror circuit and an output current from said third current mirror circuit and converts the current to a voltage which is supplied as a reference voltage.

2. The circuit according to claim 1, wherein said third current-to-voltage converting circuit comprises a resistor.

3. The circuit according to claim 1, wherein said first and second current-to-voltage converting circuits each include a diode-connected MOS transistor and a voltage-dividing resistor connected in parallel with said MOS transistor;

divided voltages from the voltage-dividing resistors of respective ones of said first and second current-to-voltage converting circuits being output as said output voltages of respective ones of said first and second current-to-voltage converting circuits.

4. The circuit according to claim 1, wherein said first current-to-voltage converting circuit has a diode and a first voltage-dividing resistor connected in parallel with said diode; and said second current-to-voltage converting circuit has a series circuit, which comprises one diode or a plurality of parallel-connected diodes and a resistor, and a second voltage-dividing resistor connected in parallel with said series circuit;

divided voltages from said first and second voltage-dividing resistors of respective ones of said first and second current-to-voltage converting circuits being output as said prescribed output voltages of respective ones of said first and second current-to-voltage converting circuits.

5. The circuit according to claim 4, wherein said diode is composed by a diode-connected bipolar transistor.

6. The circuit according to claim 1, wherein said control circuit includes a differential amplifying circuit having differential input terminals for receiving respective ones of the prescribed output voltages of said first and second current-to-voltage converting circuits, and an output terminal for delivering a voltage that controls a common node of said first to third current mirror circuits.

7. A reference voltage circuit comprising:

first to third current-to-voltage converting circuits;

first to fourth MOS transistors having gates coupled together; and a differential amplifying circuit;

wherein sources of said first and third MOS transistors are connected to a first power supply via respective ones of resistors;

sources of said second and fourth MOS transistors are connected directly to the first power supply;

said first current-to-voltage converting circuit includes a fifth MOS transistor having a drain and a gate connected to a second power supply and a source connected to a drain of said first MOS transistor, and a first voltage-dividing resistor connected in parallel with said fifth MOS transistor;

said second current-to-voltage converting circuit includes a sixth MOS transistor having a drain and a gate connected to the second power supply and a source connected to a drain of said second MOS transistor, and a second voltage-dividing resistor connected in parallel with said sixth MOS transistor;

said third current-to-voltage converting circuit comprises a resistor having a first end connected to the second power supply;

divided voltages from the first and second voltage-dividing resistors of said first and second current-to-voltage converting circuits, respectively, are applied to respective ones of differential input terminals of said differential amplifying circuit, and an output terminal of said differential amplifying circuit is connected to the coupled gates of said first to fourth MOS transistors; and drains of said third and fourth MOS transistors are coupled together and connected to a second end of said resistor of said third current-to-voltage converting circuit, and a voltage at a node of connection between drains of said third and fourth MOS transistors and said resistor of said third current-to-voltage converting circuit is output as a reference voltage.

8. The circuit according to claim 7, wherein W/L ratios of said first, fifth and sixth MOS transistors are each a prescribed multiple of a W/L ratio of said second MOS transistor, which forms a unit transistor.

9. A reference voltage circuit comprising:

first to third current-to-voltage converting circuits;

first to fourth MOS transistors having gates coupled together; and a differential amplifying circuit;

wherein sources of said first and third MOS transistors are connected to a first power supply via respective ones of resistors;

sources of said second and fourth MOS transistors are connected directly to the first power supply;

said first current-to-voltage converting circuit includes a diode having a cathode connected to a second power supply and an anode connected to a drain of said first MOS transistor, and a first voltage-dividing resistor connected in parallel with said diode;

said second current-to-voltage converting circuit includes: a series circuit, which comprises plurality of diodes having cathodes connected to the second power supply and anodes coupled together, and a resistor having a first end connected to a common node of the plurality of diodes and a second end connected to a drain of said second MOS transistor;

said third current-to-voltage converting circuit comprises a resistor having a first end connected to the second power supply;

divided voltages from said first and second voltage-dividing resistors of said first and second current-to-voltage converting circuits, respectively, are applied to respective ones of differential input terminals of said differential amplifying circuit, and an output terminal of said differential amplifying circuit is connected to the coupled gates of said first to fourth MOS transistors; and drains of said third and fourth MOS transistors are coupled together and connected to a second end of said resistor of said third current-to-voltage converting circuit, and a voltage at a node of connection between drains of said third and fourth MOS transistors and said resistor of said third current-to-voltage converting circuit is output as a reference voltage.

10. The circuit according to claim 7, wherein said first and second MOS transistors form a current mirror having a non-linear input/output characteristic, said first and third MOS transistors form a current mirror having a linear input/output characteristic, and said second and fourth MOS transistors form a current mirror having a linear input/output characteristic.

11. The circuit according to claim 9, wherein said first and second MOS transistors form a current mirror having a non-linear input/output characteristic, said first and third MOS transistors form a current mirror having a linear input/output characteristic, and said second and fourth MOS transistors form a current mirror having a linear input/output characteristic.

* * * * *